US012214940B2

(12) United States Patent
Whitfield

(10) Patent No.: US 12,214,940 B2
(45) Date of Patent: Feb. 4, 2025

(54) NON-REFILLABLE DOSING CAPILLARY INSERT

(71) Applicant: WEENER PLASTICS GROUP B.V., Ede (NL)

(72) Inventor: Adrian Michael Whitfield, Amsterdam (NL)

(73) Assignee: Weener Plastics Group B.V., Ede (NL)

( * ) Notice: Subject to any disclaimer, the term of this patent is extended or adjusted under 35 U.S.C. 154(b) by 0 days.

(21) Appl. No.: 18/041,494

(22) PCT Filed: Aug. 14, 2020

(86) PCT No.: PCT/EP2020/072921

§ 371 (c)(1),
(2) Date: Feb. 13, 2023

(87) PCT Pub. No.: WO2022/033705

PCT Pub. Date: Feb. 17, 2022

(65) Prior Publication Data

US 2024/0010399 A1 Jan. 11, 2024

(51) Int. Cl.
*B65D 49/12* (2006.01)
*B65D 47/18* (2006.01)

(52) U.S. Cl.
CPC ..... *B65D 49/12* (2013.01); *B65D 47/18* (2013.01)

(58) Field of Classification Search
CPC ... B65D 49/12; B65D 47/18; B65D 2539/003
See application file for complete search history.

(56) References Cited

U.S. PATENT DOCUMENTS 4,396,024 A * 8/1983 Sarstedt ..... A61B 5/150213 141/31
2002/0079338 A1* 6/2002 Pardo ..... B65D 47/18 222/422
2008/0118299 A1* 5/2008 Py ..... B05B 11/1032
2009/0223883 A1* 9/2009 Grevin ..... B65D 51/1616 210/151

FOREIGN PATENT DOCUMENTS

EP 0254810 2/1988
FR 2931462 A1 * 11/2009 ..... B05B 11/0054
KR 10-2006-0122332 11/2006
KR 101415854 7/2014

(Continued)

OTHER PUBLICATIONS

International Search Report and Written Opinion for International (PCT) Patent Application No. PCT/EP2020/072921, dated May 18, 2021, 11 pages.

(Continued)

*Primary Examiner* — Shawn M Braden
(74) *Attorney, Agent, or Firm* — Sheridan Ross P.C.

(57) ABSTRACT

The invention refers to a capillary insert (100) or cap that comprises a cone (110) in its upper part that ends in a skirt (120) forming a single piece, which leaves evidence if something in the insert (100) has changed or has been altered improperly. The capillary insert or cap of the present invention prevents its reuse and tampering through one or more breaking zones (130) located along the insert.

22 Claims, 7 Drawing Sheets

(56) References Cited

FOREIGN PATENT DOCUMENTS

| | | |
|---|---|---|
| WO | WO 2009/002717 | 12/2008 |
| WO | WO 2013/139352 | 9/2013 |
| WO | WO 2016/198967 | 12/2016 |

OTHER PUBLICATIONS

International Preliminary Report on Patentability for International (PCT) Patent Application No. PCT/EP2020/072921, dated Nov. 9, 2022, 12 pages.
Official Action with Machine Translation for Argentina Patent Application No. 20200103499, dated Jan. 23, 2024, 9 pages.
Official Action (with English translation) for Dominican Republic Patent Application No. P2023-0007, dated Apr. 30, 2024, 11 pages.

* cited by examiner

NON-REFILLABLE DOSING CAPILLARY INSERT

CROSS REFERENCE TO RELATED APPLICATIONS

This application is a national stage application under 35 U.S.C. § 371 and claims the benefit of PCT Application No. PCT/EP2020/072921 having an international filing date of 14 Aug. 2020, which designated the United States, the disclosure of which is incorporated herein by reference.

FIELD OF THE INVENTION

The present invention relates to the field of pharmaceutical containers and packages that allow a controlled dosage of liquid products, for example in individual drops or in a jet. More particularly, the invention relates to a tamper-proof dosing capillary cap or plug, which does not allow for reuse to be installed in the upper section of a container or package for liquid products. And a container that includes said insert or capillary cap, thus guaranteeing that the user does not fill and reuse said container.

BACKGROUND OF THE INVENTION

In the field of containers and packages for liquid products, there has been a need to develop containers that allow evidence of the opening or handling of the container, which is known in the sector as tamper evident, to offer the final consumer the security that the container or the package has not been opened, and its content has not been altered.

A container is tamper-proof, when it makes it possible to easily identify or detect unauthorized access to protected content; in general, this is carried out through seals, marks, breakable rings or other techniques that show previous manipulation.

Another need for packages and containers is that they have a design that prevents them from being refilled after their first use or from being reused for another purpose. This mainly in the containers and packages of pharmaceutical and cosmetic products.

Therefore, it has been a constant objective in the container and packaging industry, especially within the pharmaceutical industry, to provide containers for liquid products that reveal undue manipulation and that, in turn, prevents the container from being refilled or reused of any kind.

The above because the reuse of packaging can cause a user to manage or use the altered content and cause an accident.

There are several types of containers on the market that prevent tampering or that evidence the tampering. For example, patent publication WO2009002717 presents a container with evidence of tampering. This publication does not refer to a dropper, but provides a closure system for a container in which the closure is non-removably attached to the neck of the container. The security system in this container consists of tabs not visible from the outside of the closure, in which a person would have to break those seals internally in order to uncouple the closure, which, in any case, is irreversible.

Furthermore, patent publication WO2013139352 presents a container with a dispensing closure. This publication shows that the container of the invention has a system in which, when attempting to release, rotate, or even unhook the dispenser closure of the container, a predetermined rupture link (or even the outer side wall) of the base, breaks at least partially. In other words, the dispenser closure breaks if it is improperly tampered.

Publication WO2016198967A1 discloses an improved dispensing system comprising a dosing unit that includes a skirt that has a projection or edge at its lower end and a container that includes a surface located on the inside of the shoulder of the container, where the surface retains the dosing unit through interference with said projection or edge of the dosing unit. Through these characteristics the reuse of the container is prevented.

However, there is still a need to develop technologies for containers that contain liquid products that not only have a system that allows evidence of their opening or handling, for the safety of the final consumer, but also includes a mechanism that prevents reusing the container, as a dropper.

It is an object of the present invention to provide an improved capillary insert that prevents reuse of the container as a dropper or multi-dose dispenser. Another object of the invention are containers of liquid products that incorporate the improved capillary insert. Yet another object of the invention is the use of the improved capillary insert in other inserts available in the state of the art.

DESCRIPTION OF THE INVENTION

The present invention consists of a capillary insert to administer liquid products, for example in the form of drops or a jet, which is installed in the neck of a reservoir or container for the liquid to be administered. The main characteristic of the capillary insert of the present invention is that it prevents its reuse and at the same time leaves evidence that it has been manipulated, violated, detached or damaged; and therefore, the insert is unusable since it disables the proper dosage of the product.

The capillary insert of the present invention prevents its reuse and tampering through one or more break zones located along the insert.

LIST OF ELEMENTS OF THE INVENTION

Capillary insert (100)
Cone (110)
Skirt (120),
Breaking Zone (130)
Hole (111)
Internal channel (112)
Washer (114)
Thin sections of thickness (115)
Thick sections of thickness (116)
Overhang (121)
Vertical openings (122)
Container (150)
Lid (160)
Reservoir (170)

BRIEF DESCRIPTION OF THE FIGURES

The present specification is complemented with a set of illustrative drawings of the preferred and never limiting examples of the invention.

DETAILED DESCRIPTION OF THE INVENTION

The present invention provides an improved capillary insert that prevents reuse of the container as a dropper or multi-dose dispenser. The invention also relates to liquid product containers incorporating the improved capillary insert. Additionally, the invention provides the use of breaking zones in the capillary insert, in other commercially available inserts.

Figure 1:
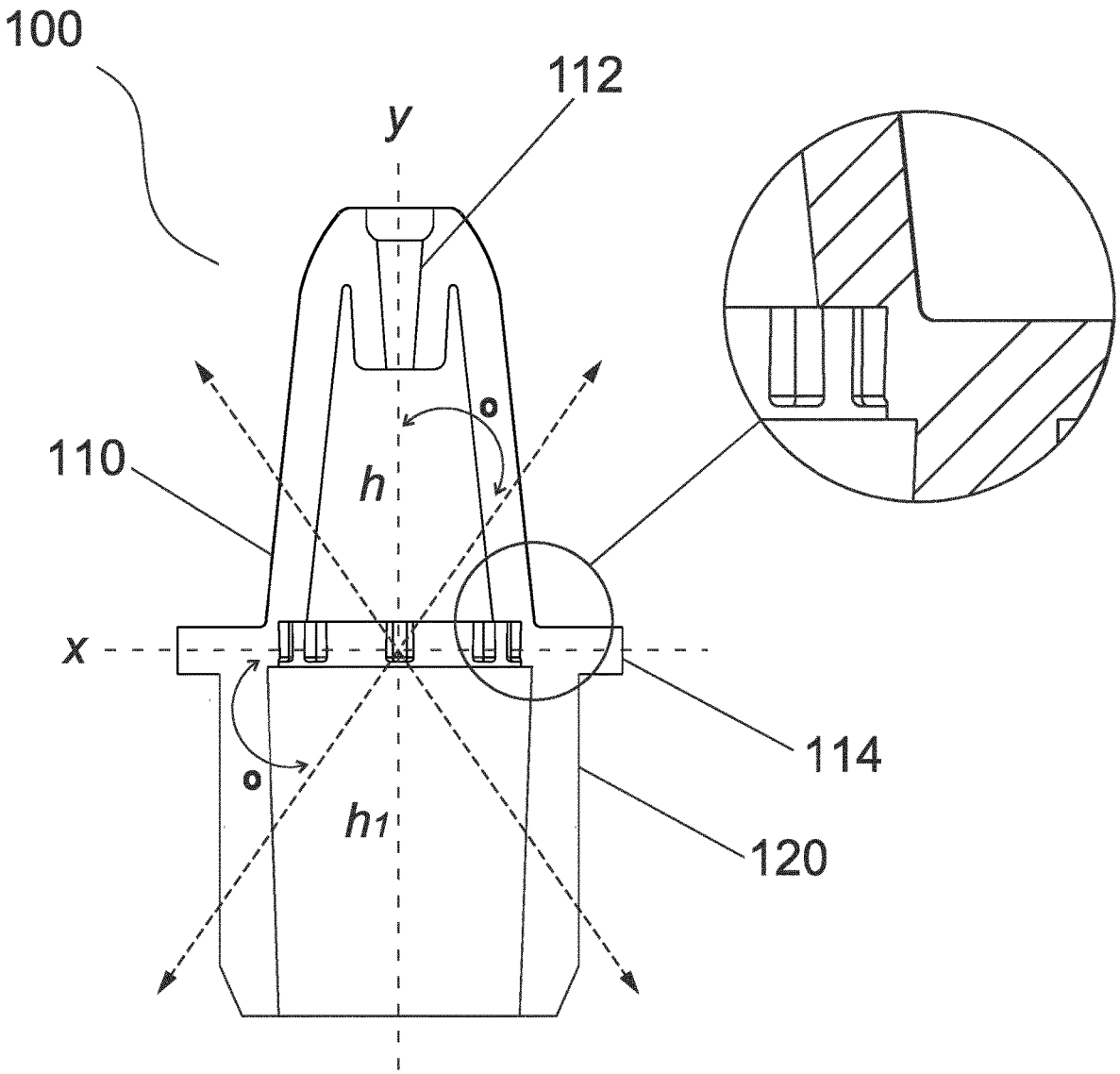
FIG. 1 shows a front sectional view of the capillary insert (100) of the invention.
Figure 2:
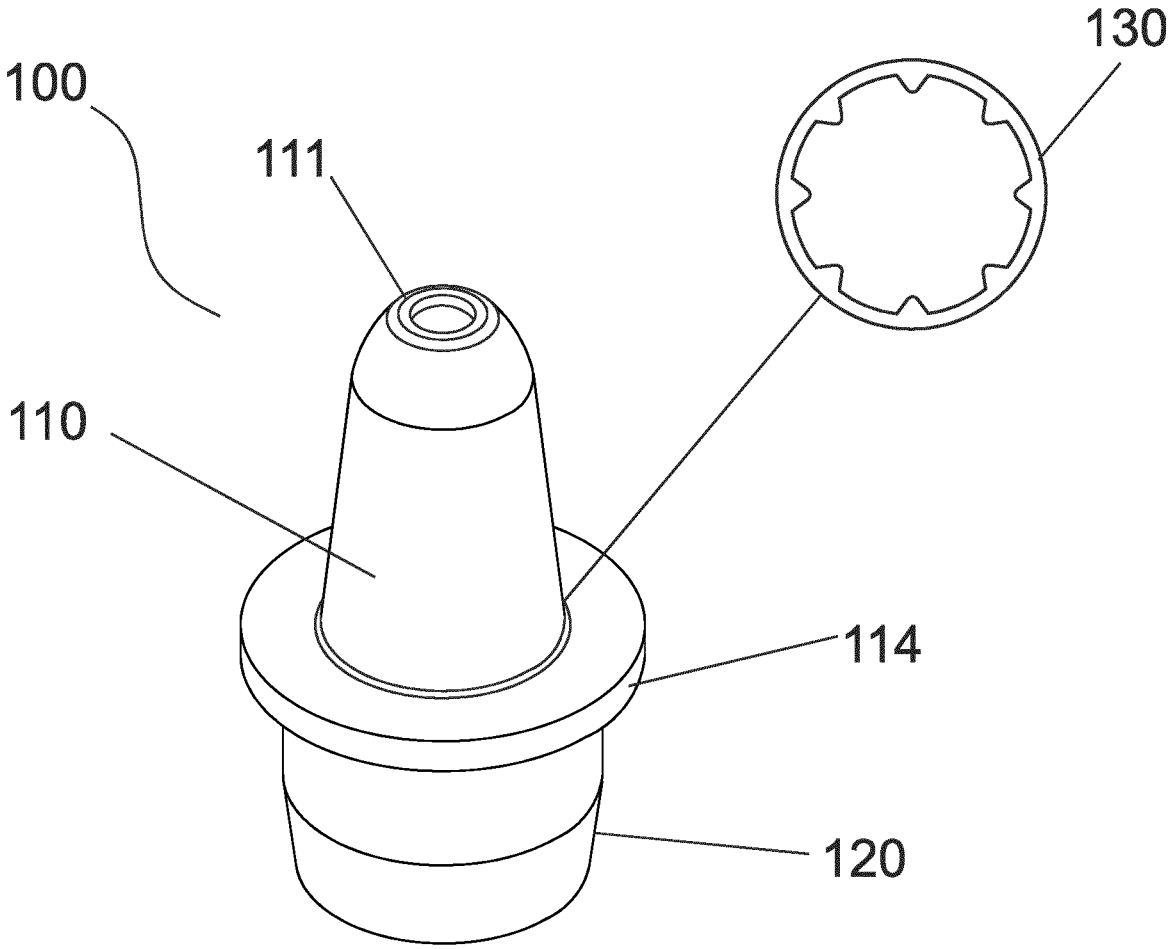
FIG. 2 shows a perspective view of the capillary insert (100), where the breaking zone (130) is shown in detail.
Figure 3:
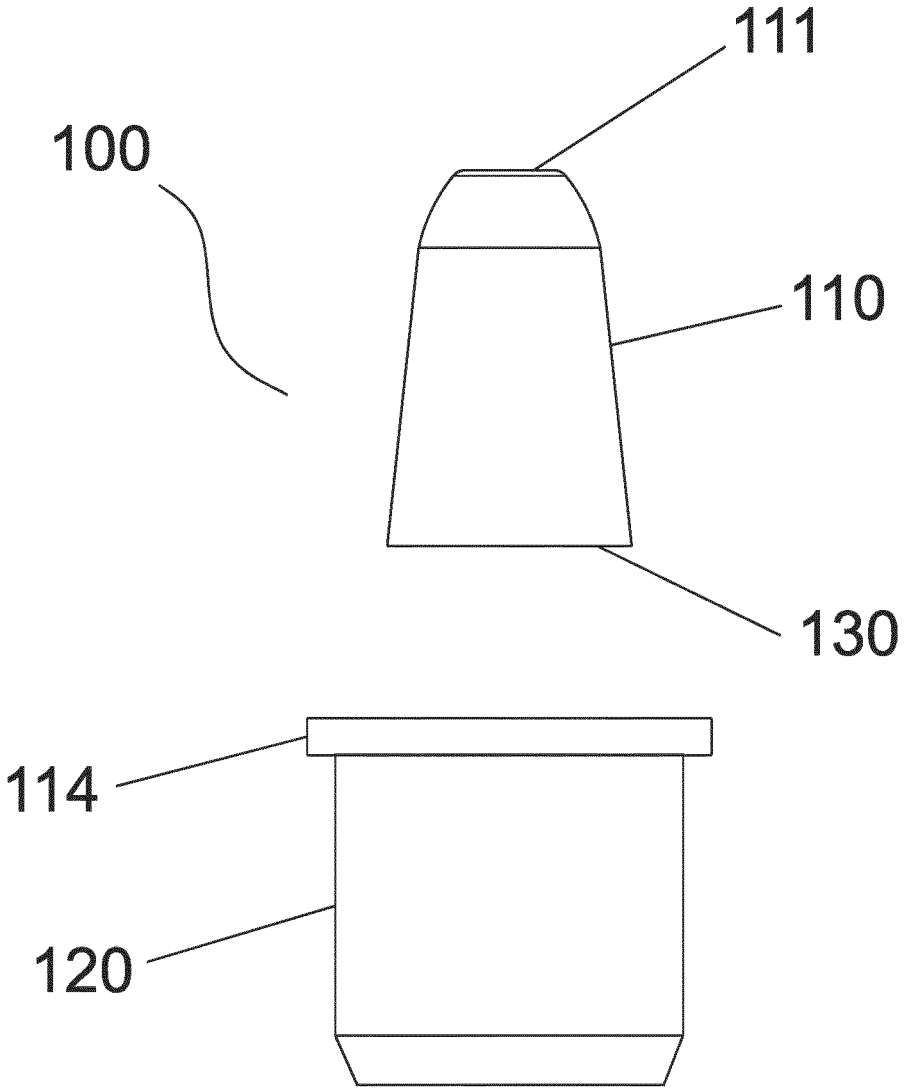
FIG. 3 shows a front view of the capillary insert (100) of the invention, where one of the modalities for breaking the cone (110) is detailed.
Figure 4:
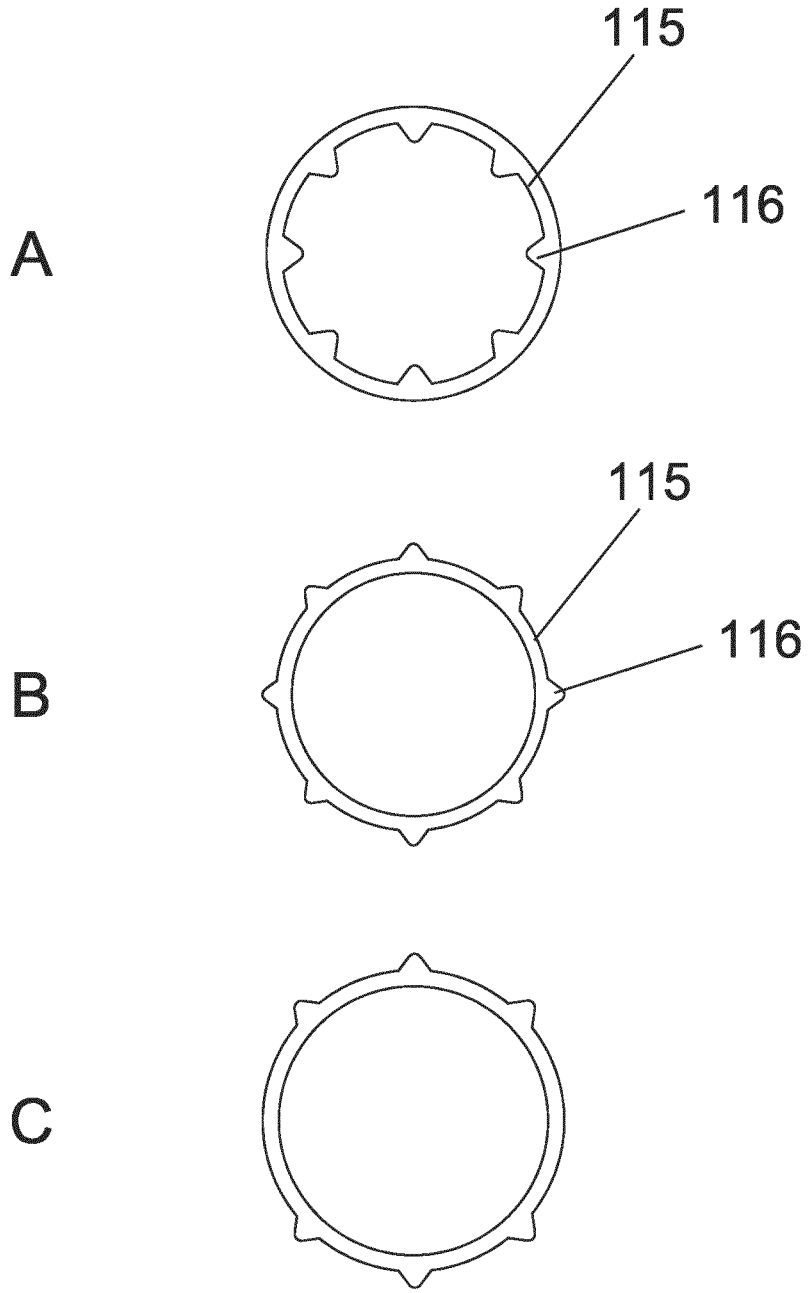
FIG. 4 shows a top view of different configurations of the thin sections of thickness (115) and the thick sections of thickness (116) of the breaking zone (130).
Figure 5A:
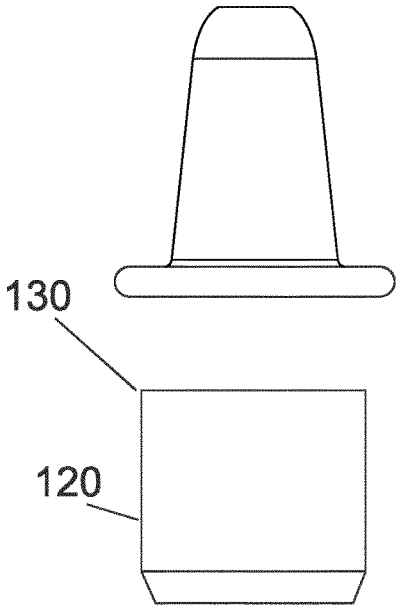
FIGS. 5*a*, 5*b* and 5*c* show frontal views of breaking modalities of the capillary insert (100).
Figure 5B:
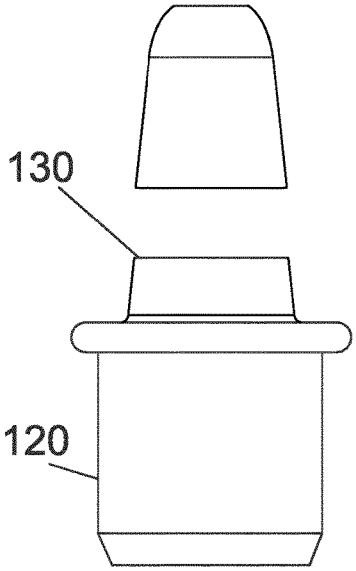
Figure 5C:
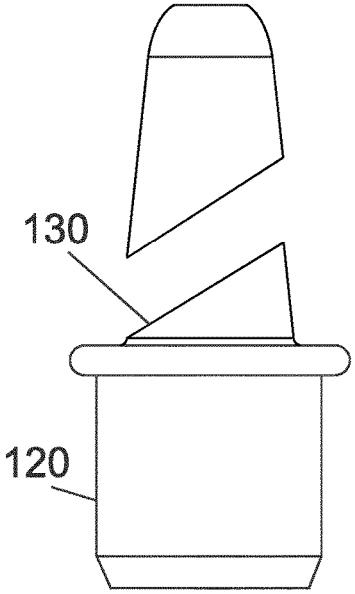
Figure 6:
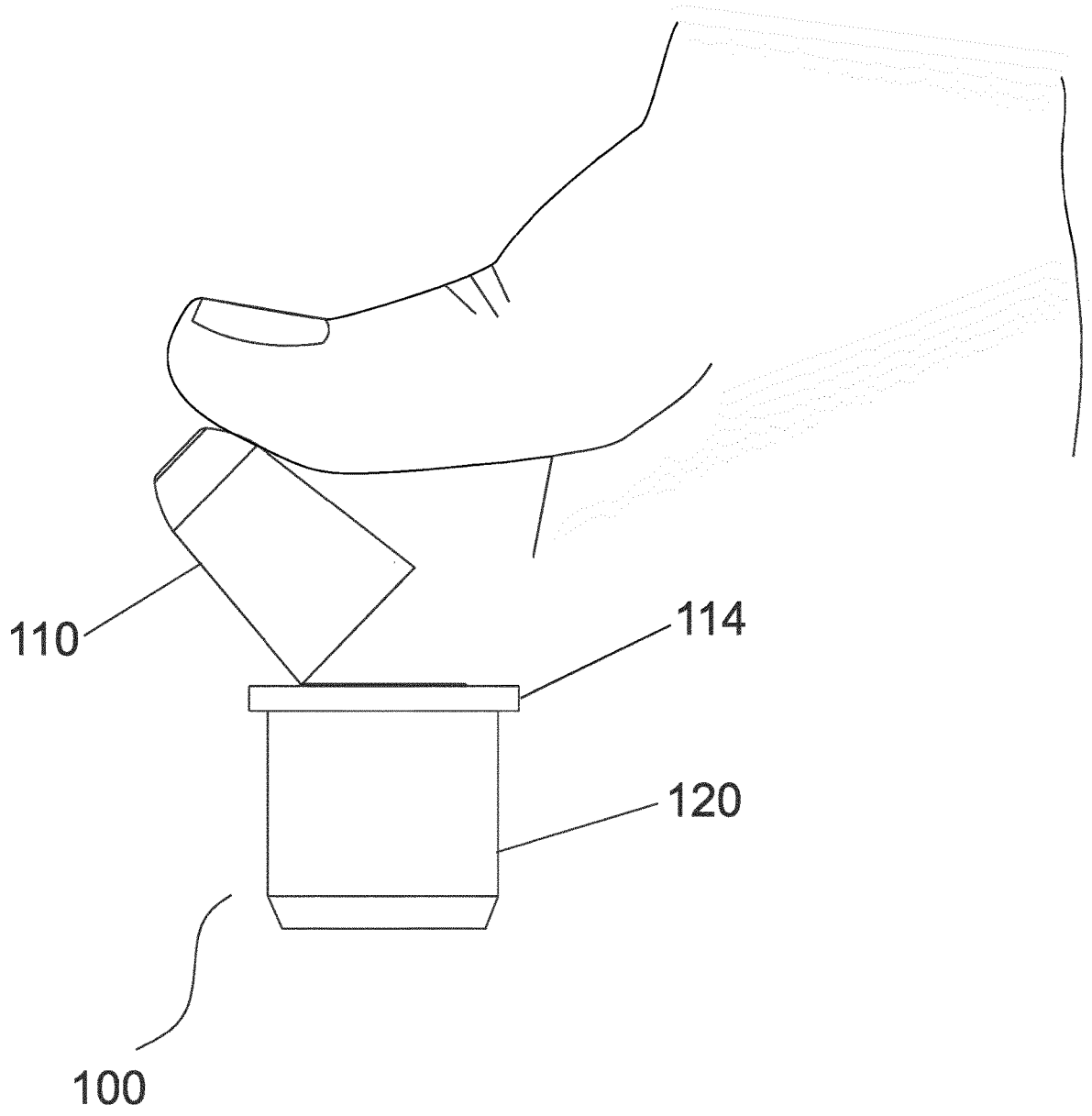
FIG. 6 shows a front view of the capillary insert (100) where the partial breakage of the cone (110) is shown.

The present invention relates to a capillary insert (100) for administering liquid products, comprising: a cone (110) that extends axially in the opposite direction to form a skirt (120), where the cone (110) has in its part upper a hole (111) for the administration of liquids through an internal channel (112), the cone (110) has a frusto-conical configuration ending in a washer (114) that divides the cone (110) and the skirt (120), wherein the insert (100) has one or more homogeneous or non-homogeneous breaking zones, as shown in FIGS. 1 and 2. Said breaking zones, when exerting an external force or subjected to an external force, allow the total or partial breaking of the insert, thanks to one or more thin sections of thickness (115) and one or more thick sections of thickness (116), as seen in FIG. 4. Both partial and total breakage make the insert useless and disables the use of the product. The external force applied can be manual, or through tools used by the user.

The one or more breaking zones (130) of the capillary insert (100) are located in the cone (110) or in the skirt (120). Examples of these breaking zones (130) are shown in FIGS. 3, 5*a*, 5*b* and 5*c*.

In the capillary insert (100) of the invention the one or more thin (115) or thick (116) sections of thickness are visible or not visible. In one embodiment of the invention, the one or more thick sections of thickness (116) are located on the inner or external part of the breaking zone, as shown in FIG. 4.

When said thin (115) or thick (116) sections of thickness are not visible, the invention refers to not being visible to the user as this depends on the insert manufacturing material, the size of the thick sections of thickness and the configuration of the thin (115) or thick (116) sections of thickness around the perimeter of the capillary insert (100).

FIG. 1 shows the one or more breaking zones in the cone (110) which are located perimeter along the y-axis and/or at any angle between 0 and 360° from the x-axis of the cone (110), at any height of a defined distance h between the top of the cone (110) and the top surface of the washer (114).

Likewise, FIG. 1 shows the one or more breaking zones in the skirt (120), which are located perimeter along the y-axis and/or at any angle between 0 and 360° from the x-axis of the skirt (120), at any height of a defined distance $h_1$ between the lower surface of the washer (114) and the base of the skirt (120).

The capillary insert (100) of the invention is made of resins from renewable and non-renewable sources.

Examples of resins from renewable sources used in the invention are selected from materials from commercially available renewable sources (e.g. ethanol), such as Bio-PE (Bio Polyethylene), Bio-PEAD/Bio-HDPE (High Density Bio Polyethylene), Bio-PEBD/Bio-LDPE (Low Density Bio Polyethylene), Bio-LLDPE (Linear Low Density Bio Polyethylene) and Bio-PP (Bio Polypropylene).

Examples of resins from non-renewable sources used in the invention are selected from polyolefins, including: Low-density polyethylene (PEBD or LDPE); high-density polyethylene (PEAD or HDPE); linear low density polyethylene (PELBD or LLDPE); polypropylene (PP); ethylene-propylene rubber (EPR); poly-alpha-olefin.

An embodiment of the invention corresponds to the use of the breaking zones (130) of the capillary insert (100) in any type of insert available on the market.

Figure 7:
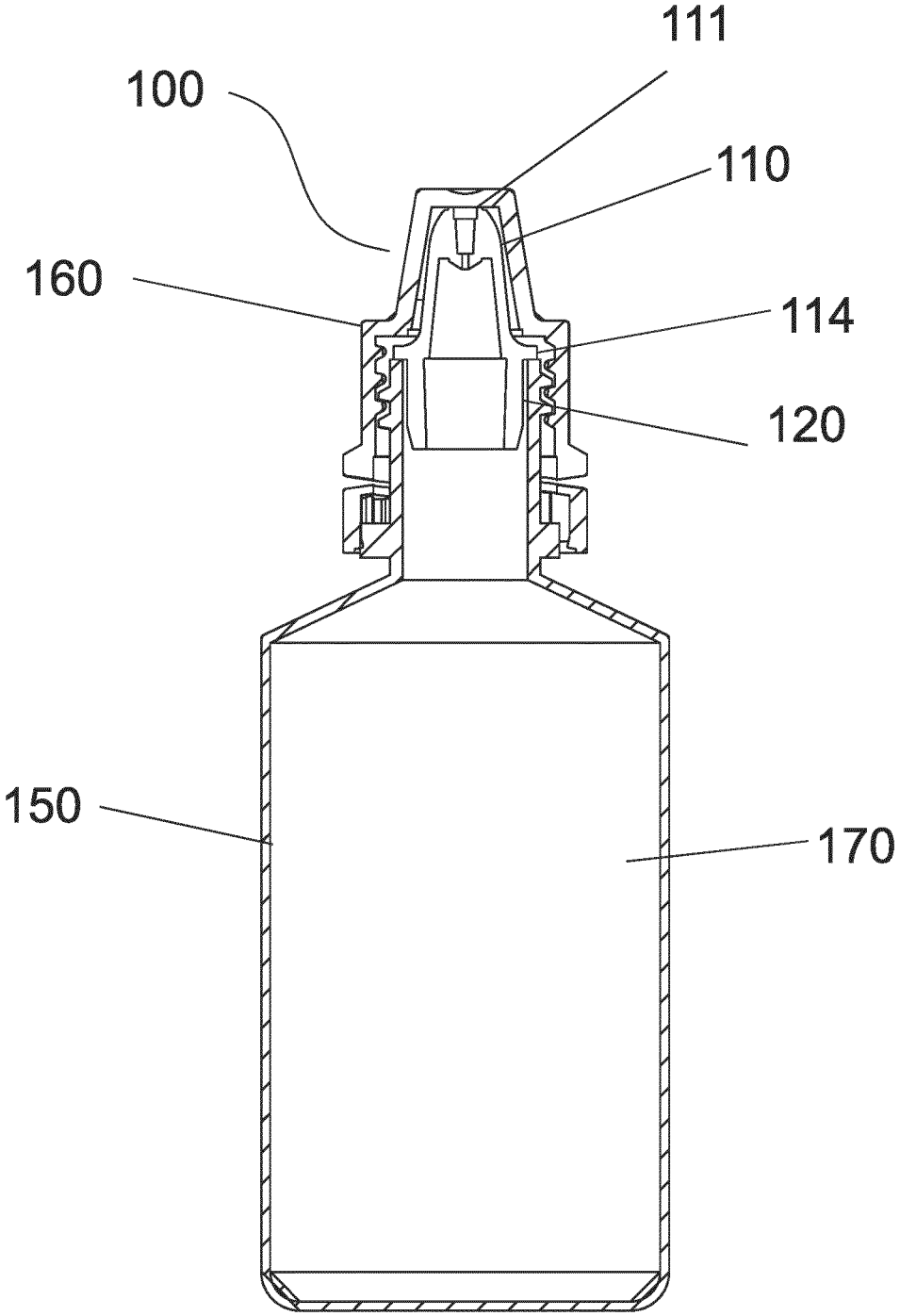
FIG. 7 shows a front sectional view of the container (150) that includes the capillary insert (100) of the invention.

Another embodiment of the invention, as shown in FIG. 7, corresponds to a liquid product dispensing container (150) comprising a lid (160); a reservoir (170) for liquid product; a capillary insert (100) arranged at the top of the reservoir (170) and under the lid (160); wherein the capillary insert (100) comprises a cone (110) that extends axially in the opposite direction to form a skirt (120), wherein the cone (110) has in its upper part a hole (111) for the administration of liquids through an internal channel (112), the cone (110) has a frusto-conical configuration ending in a washer (114) that divides the cone (110) and the skirt (120), where the insert (100) has one or more homogeneous or non-homogeneous breaking zones, which when exerting an external force or subjected to an external force allow the total or partial breaking of the insert.

INDUSTRIAL APPLICATION OF THE INVENTION

The present invention has industrial application in the packaging and container industry, particularly in the pharmaceutical industry, in that it provides an insert and a container for administration of medications or other liquid products in controlled amounts to a patient, preferably for the administration of drugs.

Other embodiments or embodiments of the present invention that are apparent to those skilled in the art from reading and practicing the present specification are understood to be included within the scope of protection of the present invention. The present specification is illustrative and not limiting of the scope of the invention.

What is claimed is:

1. A capillary insert for administering liquid products, comprising:

a cone that has in an upper part a hole for administration of a liquid product through an internal channel, the cone having a frusto-conical configuration ending in a washer; and a skirt that extends axially from the washer in a direction opposite to the cone, wherein the washer divides the cone from the skirt, wherein the capillary insert has one or more non-homogeneous breaking zones comprising one or more thin sections of thickness and one or more thick sections of thickness around a perimeter of the capillary insert, and wherein each of the one or more thin sections of thickness is thinner than each of the one or more thick sections of thickness, and wherein the one or more non-homogeneous breaking zones, when exerting an external force or subjected to an external force allow a total or partial breaking of the capillary insert.

2. The capillary insert of claim 1, wherein the one or more non-homogeneous breaking zones are in the cone or the skirt.

3. The capillary insert of claim 1, wherein the one or more thin or thick sections of thickness are visible to a user from an outside of the capillary insert.

4. The capillary insert of claim 3, wherein at least one of the one or more non-homogeneous breaking zones forms a ring, and wherein the one or more thick sections of thickness are located on a radially external side of the ring and are visible to the user from the outside of the capillary insert.

5. The capillary insert of claim 2, wherein the one or more non-homogeneous breaking zones are in the cone and are located along a perimeter around an axial direction and/or at any angle between 0 and 360° from an axis perpendicular to the axial direction of the cone, at any height of an axial distance h defined between a top of the cone and a top surface of the washer.

6. The capillary insert of claim 2, wherein the one or more non-homogeneous breaking zones are in the skirt and are located along a perimeter around an axial direction and/or at any angle between 0 and 360° from an axis perpendicular to the axial direction of the skirt, at any height of an axial distance $h_1$ defined between a lower surface of the washer and a base of the skirt.

7. The capillary insert of claim 1, wherein the capillary insert is made of Bio-PE (Bio Polyethylene), Bio-PEAD/Bio-HDPE (High Density Bio Polyethylene), Bio-PEBD/Bio-LDPE (Low Density Bio-Polyethylene), Bio-LLDPE (Linear Low Density Bio Polyethylene) Bio-PP (Bio-Polypropylene), Low-density polyethylene (PEBD or LDPE), high-density polyethylene (PEAD or HDPE), linear low density polyethylene (PELBD or LLDPE), polypropylene (PP), ethylene-propylene rubber (EPR), or poly-alpha-olefin.

8. Use of the capillary insert of claim 1, wherein the capillary insert is adapted for at least one of applying a controlled dosage of the liquid product in individual drops or in a jet, and preventing tampering.

9. A liquid product dispensing container, comprising:

a lid;

a reservoir for a liquid product; and the capillary insert of claim 1 arranged at a top of the reservoir and under the lid.

10. The capillary insert of claim 1, wherein the one or more thin sections of thickness or the one or more thick sections of thickness are not visible to a user from an outside of the capillary insert.

11. The capillary insert of claim 10, wherein at least one one of the one or more non-homogeneous breaking zones forms a ring, and wherein the one or more thick sections of thickness are located on a radially inner side of this ring and are not visible to the user from the outside of the capillary insert.

12. A capillary insert for administering liquid products, comprising:

a cone that has in an upper part a hole for administration of a liquid product through an internal channel, the cone having a frusto-conical configuration ending in a washer; and a skirt that extends axially from the washer in a direction opposite to the cone, wherein the washer divides the cone from the skirt, wherein the capillary insert has one or more homogeneous breaking zones comprising one or more thin sections of thickness and one or more thick sections of thickness around a perimeter of the capillary insert, and wherein each of the one or more thin sections of thickness is thinner than each of the one or more thick sections of thickness, and wherein the one or more homogeneous breaking zones when exerting an external force or subjected to an external force allow a total or partial breaking of the capillary insert.

13. The capillary insert of claim 12, wherein the one or more homogenous breaking zones are in the cone or the skirt.

14. The capillary insert of claim 12, wherein the one or more thin or thick sections of thickness are visible to a user from an outside of the capillary insert.

15. The capillary insert of claim 14, wherein at least one of the one or more homogeneous breaking zones forms a ring, and wherein the one or more thick sections of thickness are located on a radially external side of the ring and are visible to the user from the outside of the capillary insert.

16. The capillary insert of claim 12, wherein the one or more thin or thick sections of thickness are not visible to a user from an outside of the capillary insert.

17. The capillary insert of claim 16, wherein at least one of the one or more homogeneous breaking zones forms a ring, and wherein the one or more thick sections of thickness are located on a radially inner side of the ring and are not visible to the user from the outside of the capillary insert.

18. The capillary insert of claim 12, wherein the one or more homogenous breaking zones are in the cone and are located along a perimeter around an axial direction and/or at any angle between 0 and 360° from an axis perpendicular to the axial direction of the cone, at any height of an axial distance h defined between a top of the cone and a top surface of the washer.

19. The capillary insert of claim 12, wherein the one or more homogenous breaking zones are in the skirt and are located along a perimeter around an axial direction and/or at any angle between 0 and 360° from an axis perpendicular to the axial direction of the skirt, at any height of an axial distance $h_1$ defined between a lower surface of the washer and a base of the skirt.

20. The capillary insert of claim 12, wherein the capillary insert is made of Bio-PE (Bio Polyethylene), Bio-PEAD/Bio-HDPE (High Density Bio Polyethylene), Bio-PEBD/Bio-LDPE (Low Density Bio-Polyethylene), Bio-LLDPE (Linear Low Density Bio Polyethylene) Bio-PP (Bio-Polypropylene), Low-density polyethylene (PEBD or LDPE), high-density polyethylene (PEAD or HDPE), linear low density polyethylene (PELBD or LLDPE), polypropylene (PP), ethylene-propylene rubber (EPR), or poly-alpha-olefin.

21. Use of the capillary insert of claim 12, wherein the capillary insert is adapted for at least one of applying a controlled dosage of the liquid product in individual drops or in a jet, and preventing tampering.

22. A liquid product dispensing container, comprising:

a lid;

a reservoir for a liquid product; and the capillary insert of claim 12 arranged at a top of the reservoir and under the lid.

* * * * *